US006273816B1

(12) United States Patent
Bansal et al.

(10) Patent No.: US 6,273,816 B1
(45) Date of Patent: Aug. 14, 2001

(54) METHOD AND APPARATUS FOR REWARDING GROUPS OF COMMUNICATION SERVICE USERS

(75) Inventors: Pradeep K. Bansal, Dayton; Lee Begeja, Gillette; Carroll W. Creswell, Basking Ridge, all of NJ (US)

(73) Assignee: AT&T Corp, New York, NY (US)

( * ) Notice: Subject to any disclaimer, the term of this patent is extended or adjusted under 35 U.S.C. 154(b) by 0 days.

(21) Appl. No.: 09/273,943

(22) Filed: Mar. 22, 1999

(51) Int. Cl.[7] ..... A63F 3/06

(52) U.S. Cl. ..... 463/17; 463/41; 463/42; 273/138.2

(58) Field of Search ..... 463/17, 41, 42, 463/20; 273/138.1, 138.2

(56) References Cited

U.S. PATENT DOCUMENTS

| | | | |
|---|---|---|---|
| 4,792,968 | 12/1988 | Katz | 379/92 |
| 4,845,739 | 7/1989 | Katz | 379/92 |
| 4,996,705 | 2/1991 | Entenmann et al. | 379/91 |
| 5,073,929 | 12/1991 | Katz | 379/93 |
| 5,083,272 | 1/1992 | Walker et al. | 364/412 |
| 5,128,984 | 7/1992 | Katz | 379/92 |
| 5,251,252 | 10/1993 | Katz | 379/92 |
| 5,327,485 | 7/1994 | Leaden | 379/95 |
| 5,354,069 | 10/1994 | Guttman et al. | 273/439 |
| 5,403,999 | 4/1995 | Entenmann et al. | 235/379 |
| 5,564,700 * | 10/1996 | Celona | 463/27 |
| 5,608,785 * | 3/1997 | Kasday | 379/90 |
| 5,713,795 | 2/1998 | Kohorn | 463/17 |
| 5,835,576 | 11/1998 | Katz | 379/93.13 |

* cited by examiner

*Primary Examiner*—Benjamin H. Layno

(57) ABSTRACT

A method and apparatus can enter a call into a lottery, if the call is eligible. A group of individuals or other entities associated with the call for purposes of the lottery is identified; and if the call has won the lottery, at least one member of group is advised of the group's winning status. The odds of winning a lottery for the call can be adjusted based on a participation history for at least one member of the group. The participation history can include a past number of calls made or total call time logged by the caller, etc. Thus, for example, groups of frequent users of a communication service can be rewarded with increased odds of winning a lottery each time a request for communication services is made and communication services are provided.

21 Claims, 2 Drawing Sheets

FIG. 1
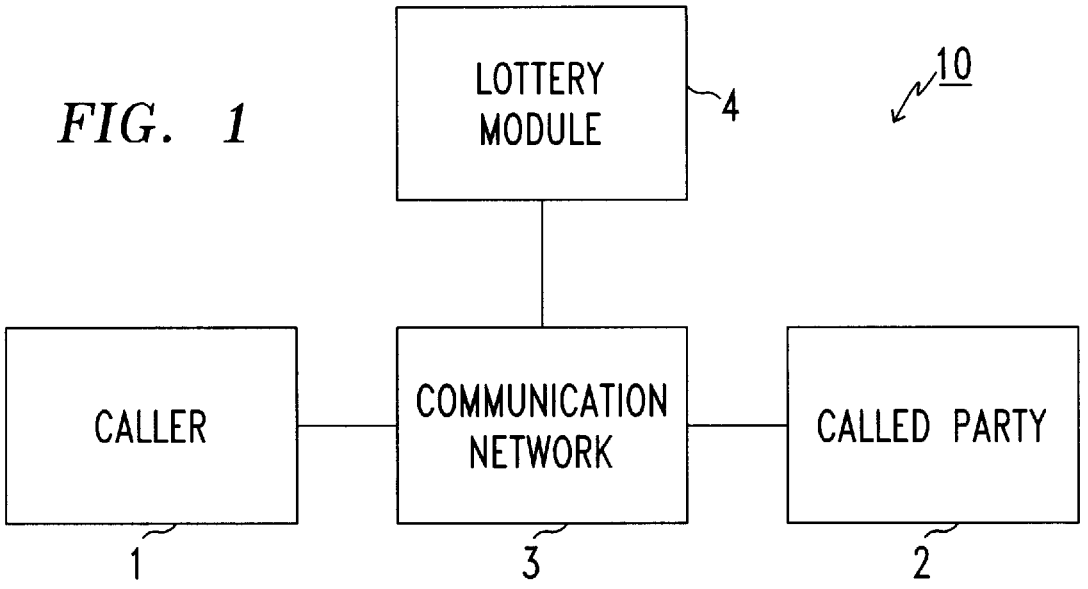
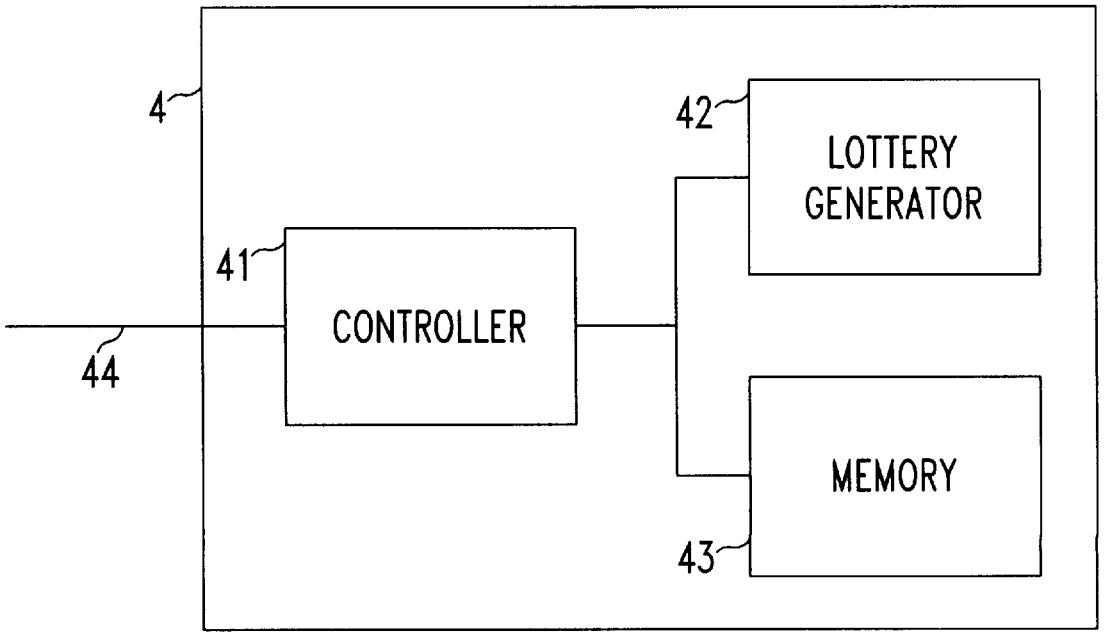
FIG. 2

METHOD AND APPARATUS FOR REWARDING GROUPS OF COMMUNICATION SERVICE USERS

RELATED APPLICATIONS

This application is related to the following concurrently filed, commonly assigned applications: Ser. No. 09/274,135, entitled "Lottery Method And Apparatus Having A Tiered Prize Scheme;" Ser. No. 09/274,143, entitled "Method And Apparatus For Determining A Caller's Odds For Winning A Lottery Based On Caller History;" Ser. No. 09/274,141, entitled "Method And Apparatus For Determining A Call-Based Lottery Winner's Prize Tier Based On Caller Participation History;" and Ser. No. 09/274,142, entitled "Method And Apparatus For Determining A Caller's Eligibility For A Lottery And Advising Lottery Winner During A Same Call."

BACKGROUND OF THE INVENTION

1. Field of Invention

This invention relates to a method and apparatus for rewarding groups of communication service users. For example, a group of communication service users can be entered into and win a lottery if one member of the group makes a call using a communication service.

2. Description of Related Art

Traditional lottery systems, or other similar games of chance, require players to purchase lottery tickets or make some other similar directed action to enter a lottery. For example, U.S. Pat. No. 5,403,999 to Entenmann et al. describes a system that allows a player to enter a lottery by calling a specific telephone number and entering the lottery over the telephone. Thus, in the Entenmann system, the player can enter, win and be advised of winning the lottery during a single telephone call specifically made to enter the lottery.

SUMMARY OF THE INVENTION

The invention provides a method and apparatus for rewarding a group of communication service users. The communication service used can be a telecommunications service or any other type of communication service including wired and wireless communication services, such as radio communication services, computer networks, the Internet, etc. A group of communication service users can be rewarded by being entered into and winning a lottery when one member of the group is associated with a call made using the communication service. For example, one member of the group could make a telephone call and, in response, be entered into and win a lottery on behalf of the group. A member of the group can be associated with a call and enter the group into a lottery by making a call, receiving a call or otherwise being associated with a call, such as by allowing another caller to make a call using the member's communication device. Groups can be formed, for example, by individuals advising a communication service provider that a group, for lottery purposes, should be formed that includes the individuals. Groups can also be automatically formed by a communication service provider; for example, a group could be automatically formed of all individuals that are associated with a particular social, civic, professional or other organization.

Thus, a member of a group need not make a specific directed action, e.g., telephone a specific telephone number, to enter and win a lottery on behalf of the group. Instead, according to at least one aspect of the invention, a group can enter and win a lottery when a caller calls any called party.

When a call is made by a caller to communicate with a called party, a group associated with the call for lottery purposes is identified. The group associated with the call for lottery purposes can be identified as a group that includes at least one of the caller, the called party or some other entity, such as the owner of a communication device (e.g., telephone) used to make the call. A determination is also made whether the call is eligible for a lottery. This determination can be made based on various criteria, e.g., the call is a credit card telephone call, a regular long-distance call, a dial-around code based call, the time of day the call was made, a "call destination", etc.

If the call is eligible for entry into a lottery, a determination can next be made whether the group corresponding to the call has won the lottery. This determination can be adjusted based on various criteria, including the number of individuals in the group and/or the group's participation history, which can include a total number of calls made by at least one member of the group over a past period of time, e.g., the last 30, 60 or 90 days, a total amount of call time used by at least one member in the group, the types of calls made/received by the group, a number of past lotteries entered, a number of past lotteries won, a type of calls made, call destination information, a time of day or day, a dial-around code for past calls, etc..

Thus, for example, the group's odds for winning the lottery can be adjusted based on the number of individuals in the group. For example, if a lottery has defined odds for winning, e.g., one in ten thousand, the group could be provided with two or more entries into the lottery to adjust the odds of winning. Alternately, the group could be given one entry into the lottery and the odds for winning the lottery could be adjusted in another way. By adjusting the odds for winning, groups of frequent callers or users of the communication system can be rewarded with increased odds of winning as compared to groups of less frequent callers. At least one member of the group can be advised that the group has won the lottery during the call that entered the group into the lottery. However, this is not necessary and the group can be advised at some later time.

A prize or group of prizes can be determined for a winning group and awarded to members of the group. A single prize, such as an amount of money, can be divided among the members of a group, either on a pro rata basis, or based on other criteria, such as a number of calls or total call minutes made by each member of the group. Alternately, a single prize can be awarded to the group. For example, a group of two people living in two different places can be awarded a single round-trip airline ticket between the two places so that one member can visit the other. Of course, other prize award schemes can be used, such as awarding each member of a group with an identical prize, e.g., a number of "free" call minutes.

These and other aspects of the invention will be appreciated and/or will be obvious in view of the description detailed below.

BRIEF DESCRIPTION OF THE DRAWINGS

The invention is described below with reference to the following drawings in which like reference numerals refer to like elements.

FIG. 1 is a schematic block diagram of a communication system configured in accordance with the invention;

FIG. 2 is a schematic block diagram of a lottery module; and

DETAILED DESCRIPTION OF PREFERRED EMBODIMENTS

Figure 3:
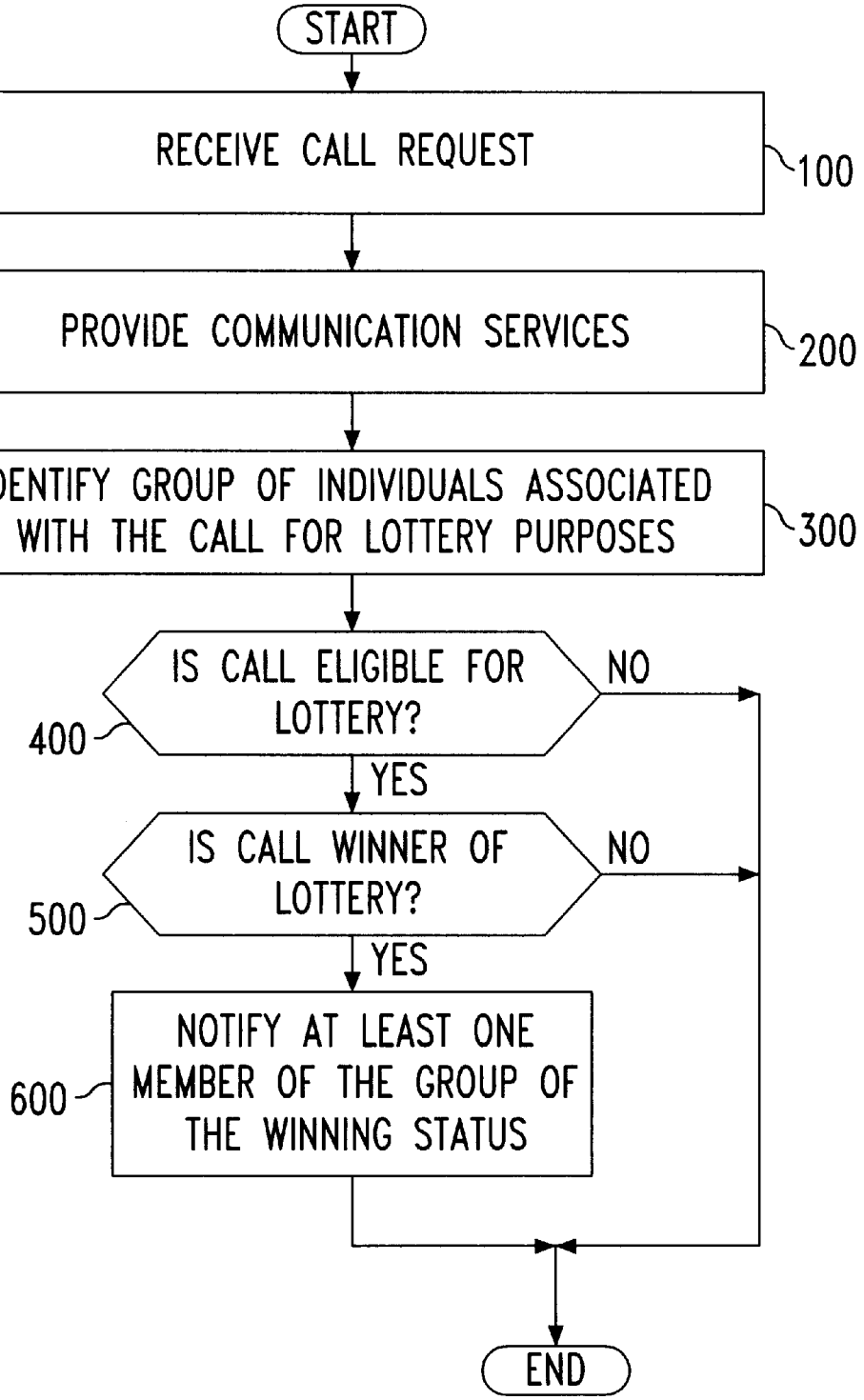
FIG. 3 is a flowchart of steps of a method for rewarding groups of communication service users.

The invention is described below in connection with a telecommunication system. That is, as described below, callers make telephone calls to request communication services and communicate with a desired called party. However, it will be appreciated that the invention can be used with other types of communication systems, including wired and wireless communication systems, computer or other similar networks such as the Internet, etc. For example, the invention could be used as part of an Internet service provider (ISP) system such that each time a user accesses the Internet, a particular web site, a particular number or combination of web sites, or other similar computer network through the ISP's system, the user or a group associated with the call can be entered into and win a lottery. The user can access the Internet, computer network or other information source through a cable, satellite or other network or combination of networks. Likewise, communication service users that connect to a particular Internet web site, or view/interact with a particular television or other communication channel (either digital or analog), can be entered into and win a lottery. For example, users could be rewarded for viewing a particular television or other similar communication channel. Thus, the invention is not limited to use with telecommunication systems.

The term called party is used in this description to refer to any person, entity, communication device or other communication destination. Likewise, the term call is used to refer to any type of communications between a caller and a called party, not just telephone calls. Thus, a caller can "call" a called party, e.g., receive information from the called party, over a telecommunications network, a computer network, the Internet, a cable network, etc.

FIG. 1 is a schematic block diagram of a communications system 10 configured in accordance with the invention. A caller 1 makes a request for communication services so that the caller 1 can communicate with a desired called party 2. The caller 1 and/or the called party 2 can be a person or communication device, as desired. The caller 1 and/or the called party 2 can use, or can include, any number of different types of communication devices, including wired and wireless telephones, facsimile machines, modems, programmed general purpose computers, etc. Thus, any one- or two-way communication device can be used for communication between the caller 1 and the called party 2.

The caller 1's request for communication services can take different forms, depending upon the type of communication network 3 used to provide the communication services. In this example, the communication network 3 is a switched telecommunications network, and so the request for communication services can include a dialed telephone number. However, the communication network 3 can include other communication systems, and the request for communication services will likely change accordingly.

When the communication network 3 receives the call request and provides communication services, e.g., sends communication information between the caller 1 and the called party 2, a lottery module 4 is notified of the call. The lottery module 4 then determines if a group associated with the caller 1, the called party 2, or another entity associated with the call is eligible for entry into a lottery. In this example, a possible other entity associated with the call could be a person, group or business entity that maintains or is otherwise associated with the communication device used by the caller 1 or the called party 2. For example, a caller 1, who is actually using a communication device to make a telephone call, may be borrowing another person's telephone to make the call. In this case, the lottery module 4 can determine that a group associated with the person who owns the telephone or is responsible for paying for calls made using the telephone is eligible for entry into the lottery, rather than a group associated with the actual caller.

In contrast, the lottery module 4 could determine whether a group associated with the actual caller 1 is eligible for entry into the lottery even if the caller 1 is not usually associated with the telephone being used to make a call. In this case, the caller 1 can enter an identification number, dial a specific access telephone number or follow some other procedure to identify the caller 1's group identity to the lottery module 4 regardless of the telephone or other communication device being used to obtain communication services.

A group associated with the called party 2 can be eligible for entry into a lottery, for example, when a called party 2 receives, and therefore pays for, a "collect"-type call or "800"-type call. Other situations are possible where a group associated with the called party 2 would be entitled to entry into a lottery. However, for ease of reference, the term group is used to refer to groups associated with the caller 1, called party 2 and/or any other entity associated with the call made.

While communication services are being provided to the caller 1, the lottery module 4 preferably determines whether the call is eligible for entry into a lottery and, if so, whether the group associated with the call for lottery purposes is a winner of the lottery. However, the call can be entered into and win a lottery after communication services have been terminated. As discussed above, the group's odds of winning the lottery can be adjusted (e.g., increased), if desired, based on the group's past participation or call history, or other factors. If the group is a winner, at least one member of the group, such as the caller 1 or called party 2, is preferably advised of the winning status while communication services are being provided. For example, the lottery module 4 could interrupt the call to advise the caller 1 of the winning status, call the caller 1 on another telephone line, display a video message on the caller 1's communication device or otherwise advise the caller 1 of the winning status. If the group is not a winner of the lottery, the lottery module 4 can either advise the caller 1 or called party 2 that the group did not win the lottery this time, or make no announcement at all to the caller 1. When the caller 1 or called party 2 wishes to terminate the communication services, e.g., by hanging up the telephone, the communication services are terminated.

FIG. 2 is a schematic block diagram of one example of a lottery module. In this example, the lottery module 4 includes a controller 41 that receives and sends signals over a line 44, which communicates with the communication network 3. For example, the controller 41 can receive a signal over the line 44 from the communication network 3 indicating that a call request has been made and communication services are being provided to a caller 1. In response to the received signal, which can include information identifying the caller 1, the call's originating telephone number, the destination telephone number, other call destination information, etc., the controller 41 identifies the group associated with the call for lottery purposes and determines whether the call is eligible for entry into a lottery. The group associated with the call for lottery purposes can be identified by comparing a caller 1's, called party 2's and/or other entity's identity (e.g., corresponding telephone number) to a stored set of group information. If the caller 1's, called party 2's or other entity's identity matches stored group information, the group associated with the call for lottery purposes can be the group to which the matching person belongs. Of course, other methods for identifying a group associated with a call for lottery purposes can be used.

The eligibility determination can be based on various factors including information received from the communication network 3 and/or other information stored in a memory 43. The memory 43 can store information such as a caller 1 or group's profile, including a number of calls made/received by callers 1/called parties 2 in the group during a past period of time, a total amount of call time used by the callers 1 or called parties 2 in the group, the types of calls made/received by the callers 1/called parties 2 in the group, etc. The controller 41 can also use information such as the time of day or day that a call is made, a specific dial-around code used to place a call, a call destination, or other information. In short, the controller 41 can use any desired information to make the eligibility determination. Alternately, all calls on the communications network 3 can be eligible for entry into a lottery.

Once the controller 41 determines that a call is eligible for entry into a lottery, the controller 41 sends a signal to a lottery generator 42 to enter the call into a lottery. The lottery generator 42 can enter the call into a standard lottery having defined odds and then provide an indication to the controller 41 whether the call has won the lottery. Alternately, the lottery generator 42 can adjust the odds of winning the lottery for the call based on the group's past participation history, which can include any of the information discussed above used to make an eligibility determination. For example, the call's odds of winning can be adjusted based on a number of calls placed by the caller 1 during a past time period, a total call time logged by the caller 1, the types of calls, e.g., credit card calls, dial-around calls, etc., a call destination such as a telephone number or geographical region, a time of day, a number of past entries into lotteries, a number of past lottery wins, etc. The odds of winning can be adjusted in any desired way, including providing the call with multiple entries into a lottery having predefined odds for winning, or providing the call with a single entry into a lottery that has adjusted odds.

If the call wins the lottery, the controller 41 sends a signal to the communication network 3 to notify at least one member of the group associated with the call of the winning status. Preferably, the caller 1 and/or the called party 2 is notified while the call that prompted entry into the lottery is ongoing. However, the caller 1 and/or called party 2 can be notified after the call has been terminated. The members of the winning group can be notified of the winning status in various ways, including providing a voice message to a member, displaying a message on a member's communication device, by telephoning the member on a separate telephone line, sending a facsimile or e-mail message to a member, etc.

The controller 41 can also determine a prize or prizes that are awarded to members of the winning lottery group. As discussed above, a single prize, such as an amount of money, can be divided among the members of a group, either on a pro rata basis or based on other criteria, such as a number of calls or total call minutes made by each member of the group. Alternately, a single prize can be awarded to the group. For example, a group of people can be awarded a travel package, e.g., an ocean cruise, for all members of the group to travel together. Of course, other prize award schemes can be used, such as awarding each member of a group with an identical prize, e.g., "free" communication services for a defined time period, such as one month.

As one example, a caller 1 in New York can place a call to a called party 2 in California using a specific dial-around code. In this example, the caller 1 and the called party 2 can be part of a group, e.g., the caller 1 and called party 2 can be family members. Of course, only the caller 1 or called party 2 can be part of a lottery group that is associated with the call, or another entity, such as the owner of a telephone used by the caller 1 to make the call, can be part of a lottery group. Communication services are provided to the caller 1 and called party 2 and the lottery module 4 receives an indication that the call is ongoing. The controller 41 determines whether the call is eligible for entry into a lottery based on desired criteria. For example, the fact that the caller 1 used the specific dial-around code could be enough to determine that the call is eligible for entry into a lottery. Alternately, other information, as discussed above, can be used for the eligibility determination. For example, the call could be determined eligible for entry into a lottery based on the fact that the caller 1 is calling California at 3 p.m. on a Thursday. Likewise, the call could be determined eligible because the caller 1, who is the member of a lottery group, has made 20 or more calls to California during the past month, for example. Such eligibility determinations are not required, however, and each call indication received by the controller 41 could prompt entry into a lottery.

Once the call is determined to be eligible and a lottery group associated with the call is identified, the lottery generator 42 determines if the call has won the lottery. The call could be entered into a lottery having defined odds, e.g., one in ten thousand, or the call's odds of winning could be adjusted as discussed above. For example, a member of the group could have made more than a threshold number of calls using a specific dial-around code during the last month, and therefore be entitled to increased odds of winning the lottery. Of course, other criteria can be used to determine whether and to what extent a call is entitled to adjusted odds of winning a lottery. Therefore, frequent callers in a lottery group can be rewarded with increased odds of winning a lottery. For example, callers in a group that make calls at a first level (e.g., total time or frequency) could be assigned a first level of odds of winning; callers in a group that make calls at a second higher level could be assigned a second higher level of odds of winning; and so on. One possible way of adjusting a call's odds is to provide the call with multiple entries into a lottery having defined odds. If the call wins the lottery, at least one member of the lottery group is advised of the winning status, preferably while communication services are being provided.

A prize or group of prizes can also be determined for a winning group. In this example, the caller 1 and the called party 2 could be advised during their call that they have won a single round-trip airline ticket for travel between New York and California. Alternately, two or more prizes, such as "free" call minutes, can be awarded to both the caller 1 and the called party 2. Of course, if neither the caller 1 nor the called party 2 are members of the winning lottery group, neither the caller 1 nor the called party 2 would be awarded a prize. Instead, actual members of the winning lottery group would be awarded with the determined prize(s).

The lottery module 4 can be implemented, at least in part, as a general purpose data processor and/or single special purpose integrated circuit (e.g., ASIC) or an array of ASICs each having a main or central processor section for overall, system-level control and separate sections dedicated to performing various specific computations, functions and other processes under the control of the central processor section. The lottery module 4 can also be implemented using a plurality of separate dedicated programmable integrated or electronic circuits or devices, e.g., hard-wired electronic or logic circuits, such as discrete element circuits or programmable logic devices. The lottery module 4 also preferably includes other devices, such as volatile or non-volatile memory devices, communication devices, and/or other circuitry or components necessary to perform the desired input/output or other functions. For example, the lottery module 4 can include an interface, such as a user interface including a keyboard, monitor, user pointing device, etc., that allows an operator to input information into and receive information from the lottery module 4. The interface may also include other communications devices, including modems or other data communication devices, to allow the lottery module 4 to receive and send information.

The memory 43 can be one or more volatile and/or non-volatile memory devices, such as optical disks, magnetic media, semiconductor or other memory devices. The lottery generator 42 can be implemented as a software module that is executed by the controller 41 or any other suitable data processing apparatus. Alternately, the lottery module 42 can be implemented as hard-wired electronic circuits or other programmed integrated or other electronic circuits or devices, e.g., hard-wired electronic or logic circuits such as discrete element circuits or programmable logic devices.

FIG. 3 is a flowchart of steps of a method for rewarding groups of communication service users. In step 100, a call request is received from a caller. For example, a call request can be a dialed telephone number or other number sequence using a telephone linked to a telecommunications network. However, the call request can be any signal or other indication that a caller would like to communicate with a called party using any type of communications system. In step 200, communication services are provided to allow communication between the caller and a called party. The communication services can include transmitting voice and/or data communications between the caller and the called party. However as discussed above, the communication services can be provided by any communication system, not just telecommunications systems.

In step 300, a group of individuals associated with the call is identified for lottery purposes. As discussed above, the group can include the caller, the called party or some other entity associated with the call. For example, a group including the called party could be identified as associated with the call for lottery purposes because the called party has received a collect-type, or 800-type call. A group including another entity, such as a person responsible for paying for communication services received when using a specific communication device involved in the call, and not including either the caller or the called party, can also be identified.

In step 400, a determination is made whether the call is eligible for a lottery. The eligibility determination can be based on various different eligibility criteria such as information regarding at least one group member's past participation history, including a number of calls or total call time for the member during a past time period, or other information related to the call such as a time of day, a call destination (e.g., a specific telephone number or geographic region), a dial-around code used to place the call, whether the call was made using a credit card, etc. This determination can be made by comparing the eligibility criteria obtained regarding the call with stored eligibility data. For example, a dial-around number used to initiate the call can be compared with a set of stored dial-around numbers; and if the obtained dial-around number matches one of the stored numbers, the call can be determined eligible for entry into a lottery. Of course, the eligibility determination can be made based on two or more criteria in any way as desired. For example, even if a dial-around number used to make a call matches a stored dial-around number, a further determination can be made whether the number of calls placed by at least one member of the group during the last month is equal to or greater than a desired threshold number. Thus, even if the caller used an appropriate dial-around number that would otherwise entitle the call to entry into a lottery, if at least one member of the group has not placed a specified number of calls using the dial-around number in the past, entry into a lottery can be denied.

Step 400 can be performed before or after step 300, as desired. For example, if the determination whether a call is eligible for a lottery is based on specific information related to the group or individuals of a group, step 400 would normally be performed after step 300. However, if the determination whether a call is eligible for a lottery is based on other information, such as the type of call, step 400 can be performed after step 300. Preferably, the eligibility determination is made while communication services in step 200 are being provided. However, the determination in steps 300 or 400 can be made after communication services have been terminated. If the call is not eligible for a lottery, flow jumps to the end of the flowchart, at which time a member of the group, such as the caller, can be advised that the call is not eligible for a lottery. However, members of the group identified in step 300 need not be advised that the call has been denied entry into a lottery.

If the call is eligible for a lottery, a determination is made in step 500 whether the call is a winner of the lottery. This determination can be made in any number of different ways, including using a random number generator to generate a number and then determining whether the randomly generated number matches or otherwise corresponds to a number associated with the call. The number assigned to the call can be a number that is assigned permanently to the group, e.g., when the group is initially formed, or can be assigned to the call when the call is entered into a lottery. However, the call can be determined to be a winner of the lottery in other ways.

For example, the call's odds of winning the lottery can be adjusted based on a call participation history for one or more members of the lottery group identified in step 300. The participation history can include information such as a number of calls recently made by a group member, a total call time logged by the group member, etc. For example, a call's odds of winning the lottery can be increased if a group member has made more than a threshold number of calls during a past time period. Thus, groups having members that frequently use a service, such as a dial-around service, can be rewarded with increased odds of winning as compared to other groups having members that less frequently use the dial-around service. The call's odds of winning can be adjusted by adjusting a number of entries allotted to the caller into a lottery, adjusting the odds of winning the lottery, etc.

The term lottery is used herein to refer to a game of chance or pseudo-game of chance such that the caller has a random, or pseudo-random, chance of winning. Thus, the lottery can be constructed to give the appearance of random winning when, in fact, the probability for a call winning the lottery is adjusted based on various criteria, including a total number of calls made or call minutes used by a member or members of a group during a recent past time period, the types of calls, e.g., credit card calls, dial-around calls, etc., a call destination such as a telephone number or geographical region, a time of day, a number of past entries into lotteries, a number of past lottery wins, etc.

If the call is determined to be a winner of the lottery, at least one member of the group is advised of the winning status in step 600. For example, a caller that is a member of the group can be advised while the communication services are being provided, or after the communication services have been terminated. The group member can be advised of the winning status in any number of different ways, including providing the member with a voice or visual message, a facsimile or e-mail transmission, etc.

The method for rewarding groups can also include a step of determining a prize or group of prizes that are awarded to members of a winning group. As described above, a single prize can be divided among members of a group, either on a pro rata basis or based on other criteria, such as each member's participation history. Alternately, individual prizes can be awarded to each member or other prize award schemes can be used.

While this invention has been described in conjunction with specific embodiments thereof, it is evident that many alternatives, modifications, and variations will be apparent to those skilled in the art. Accordingly, the embodiments of the invention as set forth herein are intended to be illustrative, not limiting. Various changes may be made without departing from the spirit and scope of the invention.

What is claimed is:

1. A method for rewarding a group of communication service users, comprising:

receiving an indication that communication services are to be provided to a caller so that the caller can communicate with a called party;

identifying a group, including at least two of the caller, the called party or an entity other than the caller and the called party, associated with the call for lottery purposes;

determining if the call is eligible for entry into a lottery;

determining if the call is a winner of the lottery; and advising at least one member of the group that the group has been determined to have won the lottery.

2. The method of claim 1, wherein the step of receiving an indication that communication services are to be provided comprises connecting the caller to the called party through a communications network.

3. The method of claim 1, wherein the step of receiving an indication that communication services are to be provided comprises sending information between the caller and the called party at least in part through a computer network.

4. The method of claim 1, wherein the step of determining if the call is a winner of the lottery comprises adjusting the call's odds of winning the lottery based on a participation history for members of the identified group.

5. The method of claim 1, wherein the step of determining if the call is a winner of the lottery comprises comparing a participation history for at least one member of the identified group to stored odds of winning criteria, wherein the participation history includes at least one of a number of past lotteries entered, a number of past lotteries won, a total number of calls made by the at least one member during a previous time period, a total amount of call time logged by the at least one member during a previous time period, a type of calls made, call destination information, a time of day or day, and a dial-around code for past calls.

6. The method of claim 1, wherein the step of determining if the call is a winner of the lottery comprises increasing an odds of winning for the call if at least one member of the identified group has made more than a threshold number of calls using a specified dial-around code during a previous time period.

7. The method of claim 1, wherein the step of advising at least one member of the group comprises advising the caller while providing communication services to the caller and the called party.

8. The method of claim 1, further comprising determining a set of at least one prize to be awarded to members of the identified group.

9. The method of claim 1, further comprising allocating prizes to members of the identified group based on a participation history for each of the members.

10. A communication system comprising:

means for receiving an indication that communication services are to be provided to a caller so that the caller can communicate with a called party;

means for identifying a group of members, including at least two of the caller, the called party or an entity other than the caller and the called party, associated with the call for lottery purposes;

means for determining if the call is eligible for entry into a lottery;

means for determining if the call is a winner of the lottery; and means for advising at least one member of the group that the group has been determined to have won the lottery.

11. The communication system of claim 10, wherein the means for advising at least one member of the group that the group has been determined to have won the lottery includes providing a voice message to a member, displaying a message on a member's communication device, telephoning the member on a separate telephone line, sending a facsimile or email to an individual from the group.

12. A lottery device associated with a communication system that provides communication services so that a caller can communicate with a called party during a call, the lottery device comprising:

a memory that stores information regarding at least a participation history for a party;

a lottery generator that determines if a call has won a lottery; and a controller that identifies a group associated with the call for lottery purposes, determines if the call is eligible to enter the lottery, and notifies at least one member of the group if the call has won the lottery.

13. The lottery device of claim 12, wherein the communication system is a telecommunications network.

14. The lottery device of claim 12, wherein the communication system includes a computer network.

15. The lottery device of claim 12, wherein the controller identifies a group of parties including at least one of the caller, the called party, and an entity other than the caller and called party.

16. The lottery device of claim 12, wherein the lottery generator adjusts a call's odds of winning the lottery based on a participation history for members of the identified group.

17. The lottery device of claim 12, wherein the lottery generator adjusts a call's odds of winning the lottery based on a comparison of a participation history for at least one member of the identified group to stored odds of winning criteria, wherein the participation history includes at least one of a number of past lotteries entered, a number of past lotteries won, a total number of calls made by the at least one member during a previous time period, a total amount of call time logged by the at least one member during a previous time period, a type of calls made, call destination information, a time of day or day, and a dial-around code for past calls.

18. The lottery device of claim 12, wherein the lottery generator increases an odds of winning for the call if at least one member of the identified group has made more than a threshold number of calls using a specified dial-around code during a previous time period.

19. The lottery device of claim 12, wherein the controller advises at least one member of the group that the group has won the lottery while providing communication services to the caller and the called party.

20. The lottery device of claim 12, wherein the controller determines a set of at least one prize to be awarded to members of the identified group.

21. The lottery device of claim 12, wherein the controller allocates prizes to members of the identified group based on a participation history for each of the members.

* * * * *